United States Patent [19]

Ueda et al.

[11] Patent Number: 4,857,502

[45] Date of Patent: Aug. 15, 1989

[54] THERMOSENSITIVE RECORDING MATERIAL

[75] Inventors: Takashi Ueda; Keiichi Maruta; Hiroshi Yaguchi, all of Numaza, Japan

[73] Assignee: Ricoh Company, Ltd., Tokyo, Japan

[21] Appl. No.: 63,869

[22] Filed: Jun. 19, 1987

[30] Foreign Application Priority Data

Jun. 19, 1986 [JP] Japan ..... 61-143946
Sep. 10, 1986 [JP] Japan ..... 61-213593

[51] Int. Cl.[4] ..... B41M 5/18

[52] U.S. Cl. ..... 503/217; 427/150; 428/913; 428/914; 503/216; 503/218; 503/221; 503/225

[58] Field of Search ..... 427/150–151; 503/216, 217, 218, 225, 221; 428/913, 914

[56] References Cited

U.S. PATENT DOCUMENTS 4,542,395 9/1985 Saito et al. ..... 503/216

FOREIGN PATENT DOCUMENTS 0230890 11/1985 Japan ..... 503/218
0231766 11/1985 Japan ..... 503/218

*Primary Examiner*—Bruce H. Hess
*Attorney, Agent, or Firm*—Oblon, Spivak, McClelland, Maier & Neustadt

[57] ABSTRACT

A thermosensitive recording material comprising a support material and a thermosensitive coloring layer formed on said support material, said thermosensitive coloring layer comprising a colorless or light-colored leuco dye and a color developer capable of inducing color formation in said leuco dye upon application of heat thereto, the improvement wherein said leuco dye is a compound having general formula (I), (I)

wherein $R^1$, $R^2$, $R^3$ and $R^4$ each represent hydrogen or an alkyl group having a substituent, $R^5$ and $R^6$ each represent hydrogen or a phenyl group which may have a substituent, and $R^7$ represents an alkyl group which may have a substituent or a phenyl group which may have a substituent, and said color developer is a compound having general formula (II), (II)

wherein $X^1$, $X^2$, $X^3$ and $X^4$ each represent hydrogen or an alkyl group having 1 to 4 carbon atoms.

6 Claims, No Drawings

THERMOSENSITIVE RECORDING MATERIAL

BACKGROUND OF THE INVENTION

The present invention relates to an improved thermosensitive recording material comprising a support and a thermosensitive coloring layer comprising a colorless or light-colored leuco dye and a color developer capable of inducing color formation in the leuco dye upon application of heat thereto.

Recording materials using leuco dyes are conventionally known and used in practice, for example, as pressure-sensitive recording sheets and thermosensitive recording sheets. A conventional thermosensitive recording material using such leuco dye is composed of a support and a thermo-sensitive coloring layer comprising a leuco dye and a color developer formed thereon. Colored images are formed on the thermosensitive coloring layer upon image-wise application of heat through a thermal resistor element to which image signals are applied.

Such thermosensitive recording materials are employed in a variety of fields, for instance, for use with printers of computers, recorders of medical analytical instruments, facsimile apparatus, automatic ticket vending apparatus, and thermosensitive copying apparatus, since they have such advantages over other conventional recording materials that (1) images can be formed by simple heat application, without complicated steps for development and image fixing, and therefore image recording can be speedily performed by a simple recording apparatus, without generation of noise and causing environmental pollution, and that (2) the thermosensitive recording materials are inexpensive.

In such conventional thermosensitive recording materials, there is usually employed in the thermosensitive coloring layer a thermal coloring system comprising a combination of (i) a colorless or light-colored leuco dye such as crystal violet lactone and leuco crystal violet which are colored in blue, and 7-anilino-substituted fluoran compounds which are colored in black, and (ii) a color developer which induces such color formation in the leuco dyes upon application of heat thereto.

In accordance with the recent development of optical character reading apparatus and bar-code reading apparatus, thermosensitive recording materials suitable for use in such reading apparatus are desired. In such reading apparatus, however, such a light source as emits light having a wavelength of 700 nm or more is in general use. However, the above-mentioned leuco dyes, when colored in blue or black, scarcely absorb light in a near infrared region, specifically light having a wavelength of 700 nm or more. Therefore, it is impossible for the above reading apparatus to read the characters or bar codes developed by the above leuco dyes.

Under such circumstances, there is a great demand for novel leuco dyes which absorb light having a wavelength of 700 nm or more when colored by a color developer.

SUMMARY OF THE INVENTION

It is therefore an object of the present invention to provide a thermosensitive recording material capable of forming colored images upon image-wise application of heat, which colored images can be read, for instance, by an optical character reading apparatus and a bar-code reading apparatus employing a semi-conductor laser.

Another object of the present invention is to provide a thermosensitive recording material capable of forming colored images which hardly fade with time and are free from fogging.

According to the present invention, the above objects of the present invention can be attained by a thermosensitive recording material comprising a support and a thermosensitive coloring layer formed thereon, which comprises at least one leuco dye having general formula (I),

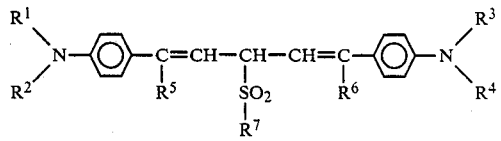

(I)

wherein $R^1$, $R^2$, $R^3$ and $R^4$ each represent hydrogen or an alkyl group having a substituent, $R^5$ and $R^6$ each represent hydrogen or a phenyl group which may have a substituent, and $R^7$ represents an alkyl group which may have a substituent or a phenyl group which may have a substituent, and a color developer having general formula (II),

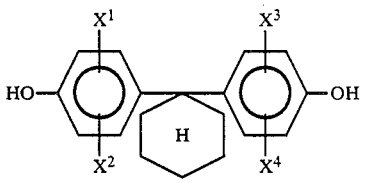

(II)

wherein $X^1$, $X^2$, $X^3$ and $X^4$ each represent hydrogen or an alkyl group having 1 to 4 carbon atoms.

DETAILED DESCRIPTION OF THE PREFERRED EMBODIMENTS

The leuco dyes having the general formula (I) can be prepared by reducing the carbonyl group of bis(p-disubstituted aminobenzal)acetone by a carbonyl reducing agent such as lithium aluminum hydride and by adding an acid such as perchloric acid thereto to form bis(p-disubstituted aminostyryl)carbenium salt, followed by causing the salt to react this salt with sodium sulfinate.

Specific examples of the leuco dye having general formula (I) for use in the present invention are as follows:

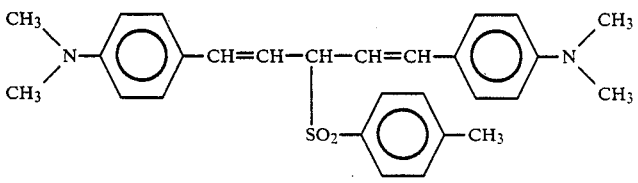

(1)

-continued
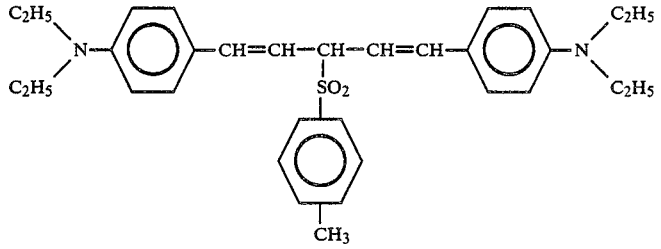
(2)
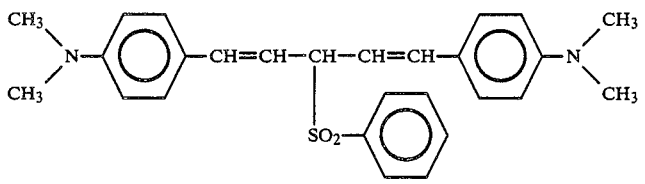
(3)
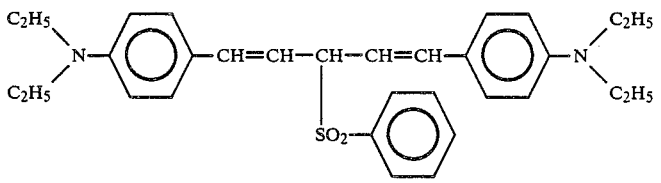
(4)
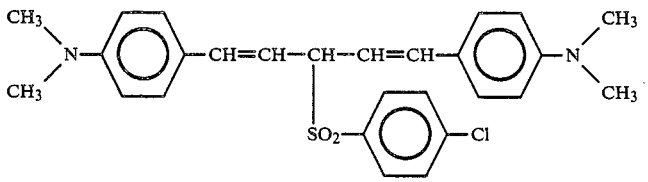
(5)
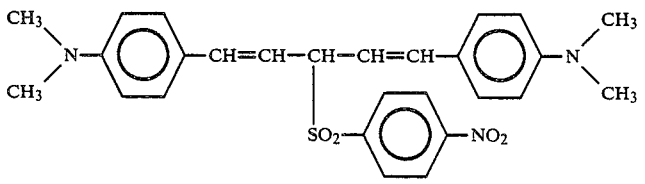
(6)
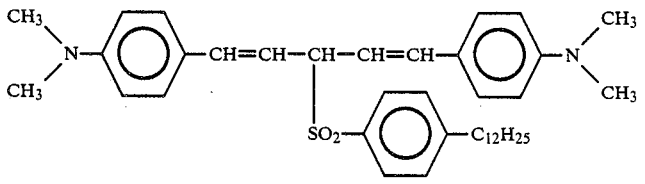
(7)
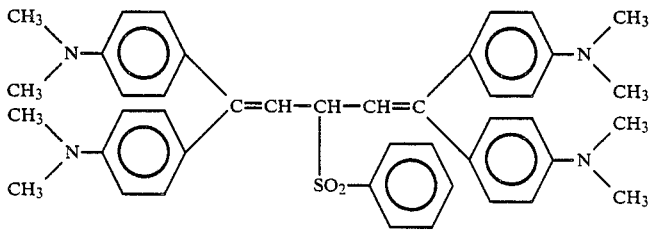
(8)

-continued (9)

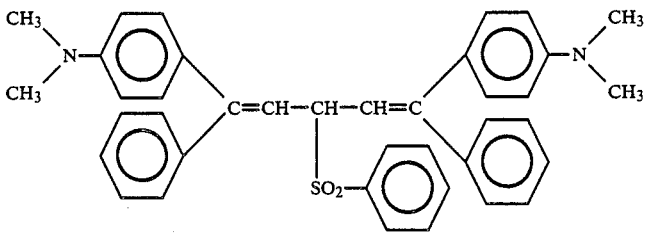

(10)

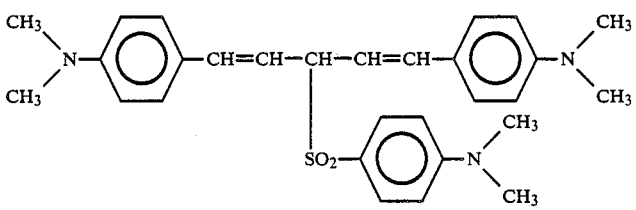

(11)

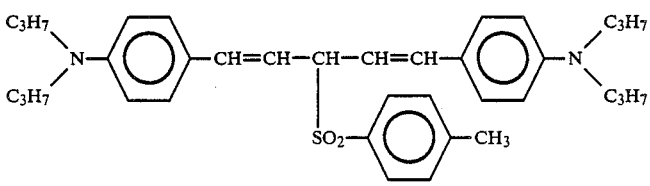

(12)

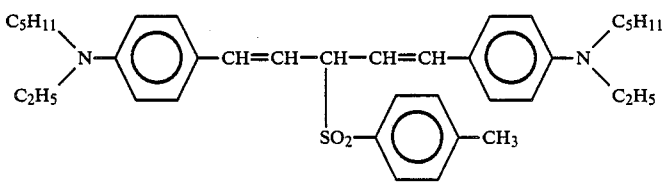

Specific examples of the color developer having the above-mentioned general formula (II) are as follows:

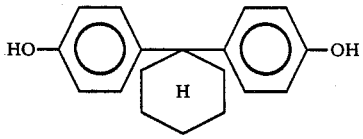

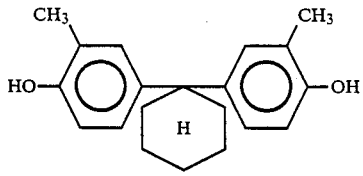

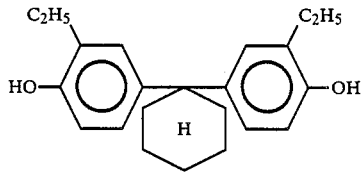

-continued

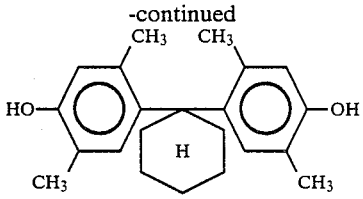

In combination with the leuco dyes of general formula (I), leuco dyes which are capable of absorbing light in the visible region, for example, leuco dyes having he following general formula (III) can be employed:

(III)

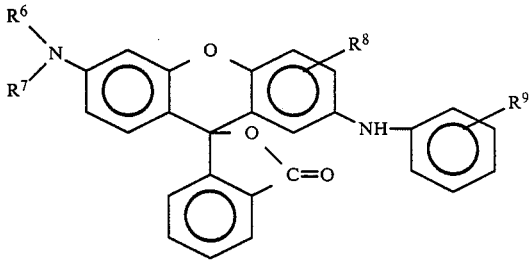

where $R^6$ and $R^7$ each represent a saturated or unsaturated hydrocarbon group having 1 to 10 carbon atoms, which may be in a cyclic or non-cyclic form and may include an ether bond therein, $R^8$ represents a hydrocarbon group having 1 to 2 carbon atoms, or halogen, and $R^9$ represents hydrogen, halogen, or a hydrocarbon group having 1 to 6 carbon atoms.

Specific examples of the leuco dye having the general formula (III), which are fluoran compounds, for use in the present invention are as follows:

3-(N-p-tolyl-N-ethylamino)-6-methyl-7-anilinofluoran,
3-diethylamino-6-methyl-7-(m-trichloromethylanilino)-fluoran,
3-diethylamino-7-(o-chloroanilino)fluoran,
3-dibutylamino-7-(o-chloroanilino)fluoran,
3-N-methyl-N-acylamino-6-methyl-7-anilinofluoran,
3-(N-methyl-N-cyclohexyl)amino-6-methyl-7-anilino-fluoran, and
3-diethylamino-6-methyl-7-anilinofluoran.

In the present invention, any conventional leuco dyes for use in conventional thermosensitive recording materials can be employed in combination with the leuco dyes having the previously mentioned general formula (I).

Examples of such conventional leuco dyes are triphenylmethane-type leuco compounds, fluoran-type leuco compounds, phenothiazine-type leuco compounds, auramine-type leuco compounds, spiropyran-type leuco compounds and indolinophthalide-type leuco compounds are preferably employed.

Specific examples of those leuco dyes are as follows:

3,3-bis(p-dimethylaminophenyl)-phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)-phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylamino-fluoran,
2-[3,6-bis(diethylamino)-9-(o-chloroanilino)xanthylbenzoic acid lactam],
3-diethylamino-6-methyl-7-(m-trichloromethylanilino)-fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilino-fluoran,
3-diethylamino-6-methyl-7-anilinofluoran,
3-(N,N-diethylamino)-5-methyl-7-(N,N-dibenzylamino)fluoran, benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)fluoran,
3-diethylamino-7-piperidinofluoran,
2-chloro-3-(N-methyltoluidino)-7-(p-n-butylanilino)-fluoran,
3-(N-benzyl-N-cyclohexylamino)-5,6-benzo-7-α-naphthylamino-4'-bromofluoran, and
3-diethylamino-6-methyl-7-mesidino-4',5'-benzofluoran.

In the present invention, the following color developers can also be employed in combination with the previously mentioned preferable color developers of general formula (III): a variety of electron acceptors can be employed, such as phenolic materials, thiophenol compounds, thiourea derivatives, organic acids and metal salts thereof.

Specific examples of such electron acceptors are bentonite, zeolite, acidic terra abla, active terra abla, colloidal silica, aluminum chloride, salicylic acid, 3-tert-butylsalicylic acid, 3,5-di-tert-butylsalicylic acid, di-m-chlorophenyl thiourea, di-m-trifluoromethylphenyl thiourea, diphenylthiourea, salicylanilide, 4,4'-isopropylidenediphenol, 4,4'-isopropylidenebis(2-chlorophenol), 4,4'-isopropylidenebis(2,6-dibromophenol), 4,4'-isopropylidenebis(2,6-dichlorophenol), 4,4'-isopropylidenebis(2-methylphenol), 4,4'-isopropylidenebis(2,6-dimethylphenol), 4,4'-isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxydiphenoxide, α-naphthol, β-naphthol, 3,5-xylenol, thymol, methyl-4-hydroxybenzoate, 4-hydroxyacetophenone, novolak-type phenolic resin, 2,2'-thiobis(4,6-dichlorophenol), catechol, resorcinol, hydroquinone, pyrogallol, phloroglucine, phloroglucinocarboxylic acid, 4-tert-octylcatechol, 2,2'-methylenebis(4-chlorophenol), 2,2'-methylenebis(4-methyl-6-tert-butylphenol), 2,2'-dihydroxy-diphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-octyl benzoic acid p-hydroxybenzoate, benzoic acid, 1-hydroxy-2-naphthoic acid, 2-hydroxy-6-naphthoic acid, 4-hydroxydiphenylsulfone, bis(4-hydroxy-3-t-butylphenyl)sulfone, 4-hydroxy-4'-chlorodiphenyl sulfone, bis(4-hydroxyphenyl)sulfide, 2-hydroxy-p-toluic acid, tartaric acid, oxalic acid, maleic acid, citric acid, succinic acid, stearic acid, 4-hydroxyphthalic acid, boric acid, biimidazole, hexaphenyl biimidazole, and carbon tetrabromide.

In the present invention, a variety of conventional binder agents can be employed for binding the above mentioned leuco dyes and color developers in the thermosensitive coloring layer to the support material.

Specific examples of such binder agents are as follows: polyvinyl alcohol; starch and starch derivatives; cellulose derivatives such as methoxycellulose, hydroxyethylcellulose, carboxymethylcellulose, methylcellulose and ethylcellulose; water-soluble polymeric materials such as sodium polyacrylate, polyvinylpyrrolidone, acrylamide/acrylic acid ester copolymer, acrylamide/acrylic acid ester/methacrylic acid copolymer, styrene/maleic anhydride copolymer alkali salt, isobutylene/maleic anhydride copolymer alkali salt, polyacrylamide, sodium alginate, gelatin and casein; and latexes of polyvinyl acetate, polyurethane, styrene/butadiene copolymer, polyacrylic acid, polyacrylic acid ester, vinyl chloride/vinyl acetate copolymer, polybutylmethacrylate, ethylene/vinyl acetate copolymer and styrene/butadiene/acrylic acid derivative copolymer.

Further in the present invention, auxiliary additive components which are employed in the conventional thermosensitive recording materials, such as a filler, a surface active agent and a thermofusible material (or unguent), can be employed.

Specific examples of a filler for use in the present invention are finely-divided inorganic powders of calcium carbonate, silica, titanium oxide, aluminum hydroxide, barium sulfate, clay, talc, surface-treated calcium and surface-treated silica, and finely-divided organic powders of urea - formaldehyde resin, styrene/-methacrylic acid copolymer, and polystyrene.

As the thermofusible materials, for example, higher fatty acids, esters, amides and metallic salts thereof, waxes, dimethylterephthalate, condensation products of aromatic carboxylic acids and amines, benzoic acid phenyl esters, higher straight chain glycols, 3,4-epoxydialkyl hexahydrophthalate, higher ketones and other thermofusible organic compounds can be employed.

When necessary, an undercoat layer comprising a filler and a water-soluble binder agent may be interposed between the support and the thermosensitive coloring layer.

Further, when the thermosensitive recording material according to the present invention is employed as thermosensitive recording label sheet, an adhesive layer is formed on the back side of the support opposite the thermosensitive layer and a disposable backing sheet is further applied to the adhesive layer, which is removed prior to its use. In this case, a protective layer comprising a water-soluble resin may be formed on the thermosensitive coloring layer to increase the stability of the images formed thereon.

With reference to the following examples, the present invention will now be explained in detail.

EXAMPLE 1-1

LIquid A-1, and Liquid C-1 were prepared by dispersing the respective components in a sand grinder for 4 hours.

| [Liquid A-1] | Parts by Weight |
|---|---|
| Bis(p-dimethylaminostyryl)-p-methylphenylsulfonylmethane | 10 |
| 10% aqueous solution of polyvinyl alcohol | 10 |
| Water | 30 |

| [Liquid C-1] | Parts by Weight |
|---|---|
| 1,1-bis(4-hydroxyphenyl)cyclohexane | 10 |
| Calcium carbonate | 10 |
| 10% aqueous solution of polyvinyl alcohol | 20 |
| Water | 60 |

Liquid A-1 and Liquid C-1 were mixed and dispersed with a ratio by weight of 1:3, so that Liquid E-1 was prepared. Liquid E-1 was coated on a sheet of high quality paper having a basis weight of 52 g/cm$^2$, with a deposition of 1.5 to 2.5 g/m$^2$ when dried, whereby a thermosensitive coloring layer was formed on the high quality paper. After drying, the thermosensitive coloring layer was subjected to calendering until the smoothness became 500 to 3000 seconds in terms of Bekk's smoothness, whereby a thermosensitive recording material No. 1-1 according to the present invention was prepared.

EXAMPLE 1-2

Liquid B-1 and Liquid D-1 were prepared by dispersing the respective components in a sand grinder for 4 hours.

| [Liquid B-1] | Parts by Weight |
|---|---|
| 3-(N—methyl-N—cylohexyl)amino-6-methyl-7-anilinofluoran | 10 |
| 10% aqueous solution of polyvinyl alcohol | 10 |
| Water | 30 |

| [Liquid D-1] | Parts by Weight |
|---|---|
| 1,7-di(4-hydroxyphenylthio)-3,5-dioxahepthane | 10 |
| Calcium carbonate | 10 |
| 10% aqueous solution of polyvinyl alcohol | 20 |
| Water | 60 |

Liquid B-1 and Liquid D-1 were mixed and dispersed with a ratio by weight of 1:3, so that Liquid F-1 was prepared.

Liquid E-1 prepared in Example 1-1 was coated on a sheet of high quality paper having a basis weight of 52 g/cm$^2$, with a deposition of 1.5 to 2.5 g/m$^2$ when dried, whereby a first thermosensitive coloring layer was formed on the high quality paper. After drying the first thermosensitive coloring layer, Liquid F-1 was coated on the first thermosensitive coloring layer with a deposition of 1.5 to 2.5 g/m$^2$ when dried, so that a second thermosensitive coloring layer was formed on the first thermosensitive coloring layer. The second thermosensitive coloring layer was subjected to calendering until the smoothness became 500 to 3000 seconds in terms of Bekk's smoothness, whereby a thermosensitive recording material No. 1-2 according to the present invention was prepared.

EXAMPLE 1-3

Example 1-2 was repeated except that Liquid F-1 was first coated on the paper to form a first thermosensitive coloring layer, and Liquid E-1 was then coated on the first thermosensitive coloring layer to form a second thermosensitive coloring layer, whereby a thermosensitive recording material No. 1-3 according to the present invention was prepared.

EXAMPLE 1-4

Liquid A-1 prepared in Example 1-1, Liquid B-1 prepared in Example 1-2, Liquid C-1 prepared in Example 1-1 and Liquid D-1 prepared in Example 1-2 were mixed and dispersed with a ratio by weight of 1:1:3:3, so that Liquid G-1 was prepared.

The thus prepared Liquid G-1 was coated on a sheet of high quality paper having a basis weight of 52 g/cm$^2$, with a deposition of 3.0 to 5.0 g/m$^2$ when dried, whereby a thermosensitive coloring layer was formed on the high quality paper. The thermosensitive coloring layer was subjected to calendering until the smoothness became 500 to 3000 seconds in terms of Bekk's smoothness, whereby a thermosensitive recording material No. 1-4 according to the present invention was prepared.

COMPARATIVE EXAMPLE 1-1

1,1-bis(4-hydroxyphenyl)cyclohexane in Liquid C-1 prepared in Example 1-1 was replaced with 4,4'-isopropylidene bisphenol, so that Liquid H-1 was prepared, specifically by dispersing the following components in a grinder for 4 hours:

| [Liquid H-1] | Parts by Weight |
|---|---|
| 4,4'-isopropylidene-bisphenol | 10 |
| Calcium carbonate | 10 |
| 10% aqueous solution of polyvinyl alcohol | 20 |
| Water | 60 |

Liquid A-1 prepared in Example 1-1 and Liquid H-1 were mixed and dispersed with a ratio by weight of 1:3, so that Liquid J-1 was prepared. Liquid J-1 was coated on a sheet of high quality paper having a basis weight of 52 g/cm$^2$, with a deposition of 1.5 to 2.5 g/m$^2$ when dried, so that a thermosensitive coloring layer was formed on the high quality paper. After drying, the thermosensitive coloring layer was subjected to calendering until the smoothness became 500 to 3000 seconds in terms of Bekk's smoothness, whereby a comparative thermosensitive recording material No. 1-1 was prepared.

COMPARATIVE EXAMPLE 1-2

1,1-bis(4-hydroxyphenyl)cyclohexane in Liquid C-1 prepared in Example 1-1 was replaced with benzyl p-hydroxybenzoate, so that Liquid I-1 was prepared, specifically by dispersing the following components in a grinder for 4 hours:

| [Liquid I-1] | Parts by Weight |
|---|---|
| benzyl p-hydroxybenzoate | 10 |
| Calcium carbonate | 10 |
| 10% aqueous solution of polyvinyl alcohol | 20 |
| Water | 60 |

Liquid A-1 prepared in Example 1-1 and Liquid I-1 were mixed and dispersed with a ratio by weight of 1:3, so that Liquid K-1 was prepared. Liquid K-1 was coated on a sheet of high quality paper having a basis weight of 52 g/cm$^2$, with a deposition of 1.5 to 2.5 g/m$^2$ when dried, so that a thermosensitive coloring layer was formed on the high quality paper. After drying, the thermosensitive coloring layer was subjected to calendering until the smoothness became 500 to 3000 seconds in terms of Bekk's smoothness, whereby a comparative thermosensitive recording material No. 1-2 was prepared.

COMPARATIVE EXAMPLE 1-3

Example 1-2 was repeated except that Liquid E-1 employed in Example 1-2 was replaced with Liquid J-1 prepared in Comparative Example 1-1, whereby a comparative thermosensitive recording material No. 1-3 was prepared.

COMPARATIVE EXAMPLE 1-4

Example 1-3 was repeated except that Liquid F-1 employed in Example 1-3 was replaced with Liquid K-1 prepared in Comparative Example 1-2, whereby a comparative thermosensitive recording material No. 1-4 was prepared.

The thus prepared thermosensitive recording materials Nos. 1-1 ~ 1-4 according to the present invention and the comparative thermosensitive recording materials Nos. 1-1 ~ 1-4 were subjected to thermal printing by use of a thermal printing test apparatus including a thermal head of a thin film type (made by Matsushita Electronic Components Co., Ltd.) under the conditions that the power applied to the head was 0.37 W/dot, the recording time per line was 5 msec, the scanning line density was 8×3.85 dots/mm, and the pulse width applied thereto was 1.0 msec.

The reflection ratios of the printed image and the background were measured by a commercially available spectrophotometer (Trademark "Hitachi 330 Type Spectrophotometer" made by Hitachi, Ltd.) with application of light having a wavelength of 900 nm.

Printed samples of the above recording materials were subjected to a heat resistant test by allowing each printed sample to stand at 60° C. and at normal room humidity for 24 hours. Thereafter, the reflection ratios of the printed image and the background of each sample were measured by the above spectrophotometer in the same manner as mentioned above.

Printed samples of the above recording materials were also subjected to a humidity resistant test by allowing each printed sample to stand at 40° C. and 90% RH for 24 hours. Thereafter, the reflection ratios of the printed image and the background of each sample were measured by the above spectrophotometer in the same manner as mentioned above.

The results of the above tests are shown in Table 1.

TABLE 1

| | Initial Reflection Ratio (%) | | Reflection Ratio (%) After Heat Resistant Test | | Reflection Ratio (%) After Humidity Resistant Test | | |
|---|---|---|---|---|---|---|---|
| | Image Area | Back-Ground | Image Area | Back-Ground | Image Area | Back-Ground | Developed Color Tone |
| Example 1-1 | 12.6 | 94.2 | 13.7 | 92.7 | 14.0 | 89.7 | Greenish Blue |
| Example 1-2 | 14.6 | 94.6 | 15.1 | 92.5 | 15.1 | 89.9 | Black |
| Example 1-3 | 13.1 | 94.1 | 14.5 | 91.8 | 14.6 | 88.6 | Greenish Black |
| Example 1-4 | 11.1 | 94.1 | 16.4 | 91.5 | 15.8 | 89.1 | Greenish Black |
| Comparative Example 1-1 | 14.2 | 93.5 | 45.9 | 90.2 | 35.6 | 84.7 | Greenish Blue |
| Comparative Example 1-2 | 32.8 | 95.1 | 86.9 | 93.8 | 62.1 | 92.0 | Greenish Blue |
| Comparative Example 1-3 | 14.3 | 94.1 | 48.6 | 90.7 | 38.2 | 85.0 | Black |
| Comparative Example 1-4 | 31.4 | 96.1 | 90.0 | 94.0 | 68.0 | 92.4 | Black |

The above results indicate that the thermosensitive recording materials according to the present invention can yield images with high density which absorb light having a wavelength of 900 nm. The obtained images are resistant to heat and high humidity. Black or dark green images can be obtained by using a thermosensitive coloring layer which yields black color in addition to the thermosensitive coloring layer in which the leuco dye of the formula (I) and the color developer of the formula (II) as in Examples 1-2 and 1-3 are contained.

EXAMPLE 2-1

Liquid A-2 and Liquid C-2 were prepared by dispersing the following respective components in a sand grinder for 2 to 4 hours.

| [Liquid A-2] | Parts by Weight |
|---|---|
| Bis(p-dimethylaminostyryl)-p-methylphenylsulfonylmethane | 10 |
| 10% aqueous solution of polyvinyl alcohol | 10 |
| Water | 55 |

| [Liquid C-2] | Parts by Weight |
|---|---|
| 1,1-bis(4-hydroxyphenyl)cyclohexane | 30 |
| Calcium carbonate | 30 |
| 10% aqueous solution of polyvinyl alcohol | 60 |
| Water | 180 |

Liquid A-2 and Liquid C-2 were mixed and dispersed with a ratio by weight of 1:1, so that Liquid D-2 was prepared. Liquid D-2 was coated on a sheet of high quality paper having a basis weight of 52 g/cm$^2$, with a deposition of 4 to 5 g/m$^2$ when dried, whereby a thermosensitive coloring layer was formed on the high quality paper. After drying, the thermosensitive coloring layer was subjected to calendering until the smoothness became 500 to 3000 seconds in terms of Bekk's smoothness, whereby a thermosensitive recording material No. 2-1 according to the present invention was prepared.

EXAMPLE 2-2

Liquid B-2 was prepared by dispersing the following components in a sand grinder for 2 to 4 hours.

| [Liquid B-2] | Parts by Weight |
|---|---|
| 3-(N—methyl-N—cyclohexyl)amino-6-methyl-7-anilinofluoran | 10 |
| 10% aqueous solution of polyvinyl alcohol | 10 |
| Water | 55 |

Liquid A-2 prepared in Example 2-1, Liquid B-2 and Liquid C-1 prepared in Example 2-1 were mixed and dispersed with a ratio by weight of 1:1:2, so that Liquid E-2 was prepared.

Liquid E-2 was coated on a sheet of high quality paper having a basis weight of 52 g/cm$^2$, with a deposition of 4 to 5 g/m$^2$ when dried, whereby a thermosensitive coloring layer was formed on the high quality paper. After drying the thermosensitive coloring layer, the thermosensitive coloring layer was subjected to calendering until the smoothness became 500 to 3000 seconds in terms of Bekk's smoothness, whereby a thermosensitive recording material No. 2-2 according to the present invention was prepared.

COMPARATIVE EXAMPLE 2-1

1,1-bis(4-hydroxyphenyl)cyclohexane in Liquid C-2 prepared in Example 2-1 was replaced with 4,4'-dihydroxyphenyl sulfone, so that Liquid F-2 was prepared, specifically by dispersing the following components for about 4 hours.

| [Liquid F-2] | Parts by Weight |
|---|---|
| 4,4'-dihydroxyphenyl sulfone | 30 |
| Calcium carbonate | 30 |
| 10% aqueous solution of polyvinyl alcohol | 60 |
| Water | 180 |

Liquid A-2 prepared in Example 2-1 and Liquid F-2 were mixed and dispersed with a ratio by weight of 1:1, so that Liquid G-2 was prepared. Liquid G-2 was coated on a sheet of high quality paper having a basis weight of 52 g/cm$^2$, with a deposition of 4 to 5 g/m$^2$ when dried, so that a thermosensitive coloring layer was formed on the high quality paper. After drying, the thermosensitive coloring layer was subjected to calendering until the smoothness became 500 to 3000 seconds in terms of Bekk's smoothness, whereby a comparative thermosensitive recording material No. 2-1 was prepared.

COMPARATIVE EXAMPLE 2-2

Liquid A-2 prepared in Example 2-1, Liquid B-2 prepared in Example 2-2 and Liquid F-2 prepared in Comparative Example 2-1 were mixed and dispersed with a ratio by weight of 1:1:2, so that Liquid H-2 was prepared. Liquid H-2 was coated on a sheet of high quality paper having a basis weight of 52 g/cm$^2$, with a deposition of 4 to 5 g/m$^2$ when dried, so that a thermosensitive coloring layer was formed on the high quality paper. After drying, the thermosensitive coloring layer was subjected to calendering until the smoothness became 500 to 3000 seconds in terms of Bekk's smoothness, whereby a comparative thermosensitive recording material No. 2-2 was prepared.

The thus prepared thermosensitive recording materials Nos. 2-1 and 2-2 according to the present invention and the comparative thermosensitive recording materials Nos. 2-1 and 2-2 were subjected to thermal printing by use of a thermal printing test apparatus including a thermal head of a thin film type (made by Matsushita Electronic Components Co., Ltd.) under the conditions that the power applied to the head was 0.37 W/dot, the recording time per line was 5 msec, the scanning line density was 8×3.85 dots/mm, and the pulse width applied thereto was 1.0 msec.

The reflection ratios of the printed image and the background were measured by a commercially available spectrophotometer (Trademark "Hitachi 330 Type Spectrophotometer" made by Hitachi, Ltd.) with application of light having a wavelength of 900 nm.

Printed samples of the above recording materials were subjected to a humidity resistant test by allowing each printed sample to stand at 40° C. and 90% RH for 24 hours. Thereafter, the reflection ratios of the printed image and the background of each sample were measured by the above spectrophotometer in the same manner as mentioned above.

Further, the PCS value of each printed sample, which is defined by the following formula, was obtained before and after the above humidity resistance test:

$$PSC\ \text{Value}\ (\%) = \frac{\left(\begin{array}{c}\text{Reflection Ratio}\\ \text{of Background}\end{array}\right) - \left(\begin{array}{c}\text{Reflection Ratio}\\ \text{of Image Area}\end{array}\right)}{\text{Reflection Ratio of Background}} \times 100\%$$

The results of the above tests are shown in Table 2.

TABLE 2

| | Initial Reflection Ratio (%) | | Reflection Ratio After Humidity Resistant Test | | PCS Value (%) | |
|---|---|---|---|---|---|---|
| | Image Area | Back-Ground | Image Area | Back-Ground | Image Area | Back-Ground |
| Ex. 2-1 | 14.6 | 92.2 | 14.0 | 89.7 | 84.2 | 84.3 |
| 2-2 | 15.2 | 91.8 | 15.8 | 89.1 | 83.4 | 82.2 |
| Comp. Ex. 2-1 | 11.5 | 88.7 | 15.7 | 79.8 | 87.0 | 80.3 |
| 2-2 | 12.2 | 88.4 | 16.1 | 78.4 | 86.2 | 79.5 |

The above results indicate that the thermosensitive recording materials according to the present invention can yield images with higher PCS values after the humidity resistant tests as compared with the comparative examples. The obtained images are resistant to high humidity and scarcely fade.

EXAMPLE 3-1

Liquid A-3, Liquid B-3 and Liquid C-3 were prepared by dispersing the respective components in a sand grinder for 1 to 2 hours.

| [Liquid A-3] | Parts by Weight |
|---|---|
| Bis-(p-dimethylaminostyryl)-p-methylphenylsulfonylmethane | 10 |
| 10% aqueous solution of polyvinyl alcohol | 10 |
| Water | 55 |

| [Liquid B-3] | Parts by Weight |
|---|---|
| 3-(N—methyl-N—cyclohexyl)amino-6-methyl-7-anilinofluoran | 10 |
| 10% aqueous solution of polyvinyl alcohol | 10 |
| Water | 55 |

| [Liquid C-31] | Parts by Weight |
|---|---|
| 4,4'-isopropylidene diphenol | 20 |
| Calcium carbonate | 15 |
| 10% aqueous solution of polyvinyl alcohol | 35 |
| Water | 130 |

Liquid A-3, Liquid B-3, and Liquid C-3 were mixed and dispersed with a ratio by weight of 1:1:2, so that Liquid D-3 was prepared. Liquid D-3 was coated on a sheet of high quality paper having a basis weight of 52 g/cm$^2$, with a deposition of 2.5 to 3.0 g/m$^2$ when dried, whereby a theromosensitive coloring layer was formed on the high quality paper. After drying, the thermosensitive coloring layer was subjected to calendering until the smoothness became 500 to 3000 seconds in terms of Bekk's smoothness, whereby a thermosensitive recording material No. 3-1 according to the present invention was prepared.

EXAMPLE 3-2

Liquid A-3 and Liquid C-3 prepared in Example 3-1 were mixed and dispersed with a ratio by weight of 1:1, so that Liquid E-3 was prepared.

Liquid B-3 and Liquid C-3 prepared in Example 3-1 were mixed and dispersed with a ratio by weight of 1:1, so that a second thermosensitive coloring layer coating liquid F-3 was prepared.

Liquid E-3 was first coated on a sheet of high quality paper having a basis weight of 52 g/cm$^2$, with a deposition of 1.0 to 1.5 g/m$^2$ when dried, whereby a first thermosensitive coloring layer was formed on the high quality paper. After drying the first thermosensitive coloring layer, Liquid F-3 was then coated on the first thermosensitive coloring layer with a deposition of 1.0 to 1.5 g/m$^2$ when dried, so that a second thermosensitive coloring layer was formed on the first thermosensitive coloring layer. The second thermosensitive coloring layer was subjected to calendering until the smoothness became 500 to 3000 seconds in terms of Bekk's smoothness, whereby a thermosensitive recording material No. 3-2 according to the present invention was prepared.

EXAMPLE 3-3

Example 3-2 was repeated except that Liquid F-3 was first coated on the paper with a deposition of 1.0 to 1.5 g/m$^2$ when dried to form a first thermosensitive coloring layer, and Liquid E-3 was then coated on the first thermosensitive coloring layer with a deposition of 1.0 to 1.5 g/m$^2$ when dried to form a second thermosensitive coloring layer, whereby a thermosensitive recording material No. 3-3 according to the present invention was prepared.

COMPARATIVE EXAMPLE 3

Liquid D-3 prepared in Example 3-2 was coated on a sheet of high quality paper having a basis weight of 52 g/cm$^2$, with a deposition of 1.0 to 1.5 g/m$^2$ when dried, whereby a thermosensitive coloring layer was formed on the high quality paper. The thermosensitive coloring layer was subjected to calendering until the smoothness became 500 to 3000 seconds in terms of Bekk's smoothness, whereby a comparative thermosensitive recording material No. was prepared.

The thus prepared thermosensitive recording materials Nos 3-1 ~ 3-3 according to the present invention and the comparative thermosensitive recording material No. 3-1 was subjected to a thermal printing test by use of a commercially available heat gradient test apparatus at 110° C. with application of a printing pressure of 2 kg/cm$^2$ for 1 second, and the maximum image density of the formed images and the background density were measured by use of a Macbeth densitometer with a filter W-106.

The reflection ratios of the printed image and the background of printed samples were measured by the spectrophotometer (Trademark "Hitachi 330 Type Spectro-photometer" made by Hitachi, Ltd.) with application of light having a wavelength of 900 nm, so that the PCS values of the printed images were determined as in Example 2-1.

The results of the above tests are shown in Table 3.

TABLE 3

| | Maximum Colored Density | PCS Value at 900 nm | Developed Color Tone |
|---|---|---|---|
| Example 3-1 | 1.30 | 78% | Black |
| Example 3-2 | 1.35 | 81% | Black |
| Example 3-3 | 1.28 | 82% | Greenish Black |
| Comparative Example 3 | 0.82 | 84% | Dark Blue |

What is claimed is:

1. In a thermosensitive recording material comprising a support material and a thermosensitive coloring layer formed on said support material, said thermosensitive coloring layer comprising a colorless or light-colored leuco dye and a color developer capable of inducing color formation in said leuco dye upon application of heat thereto, the improvement wherein said leuco dye is a compound having general formula (I),

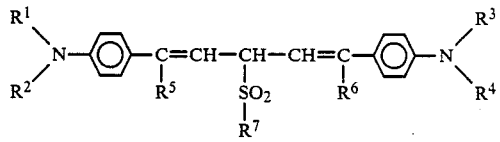

(I)

wherein $R^1$, $R^2$, $R^3$ and $R^4$ each represent hydrogen or an alkyl group having a substituent, $R^5$ and $R^6$ each represent hydrogen or a phenyl group which may have a substituent, and $R^7$ represents an alkyl group which may have a substituent or a phenyl group which may have a substituent, and said color developer is a compound having general formula (II),

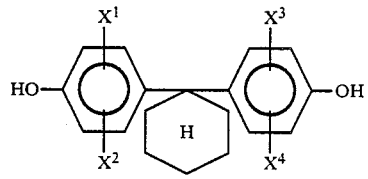

(II)

wherein $X^1$, $X^2$, $X^3$ and $X^4$ each represent hydrogen or an alkyl group having 1 to 4 carbon atoms.

2. The thermosensitive recording material as claimed in claim 1, wherein said leuco dye is selected from the group consisting of:

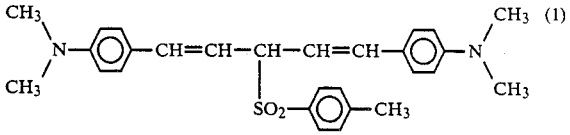

(1)

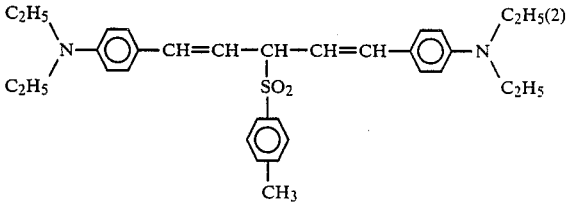

(2)

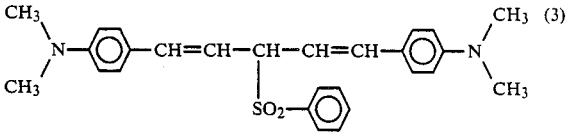

(3)

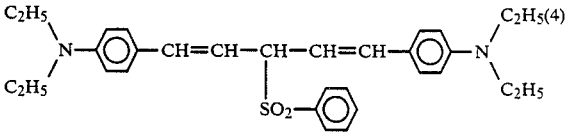

(4)

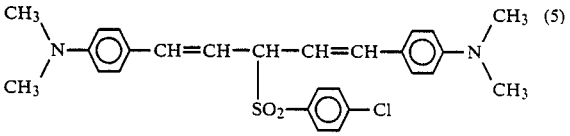

(5)

-continued

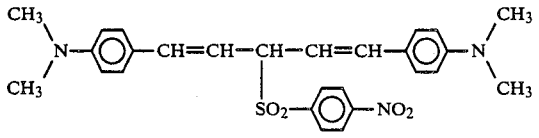

(6)

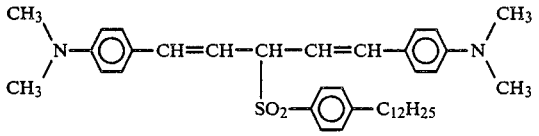

(7)

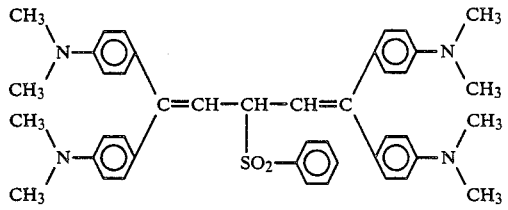

(8)

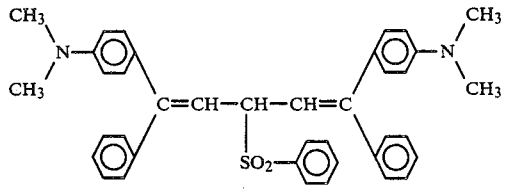

(9)

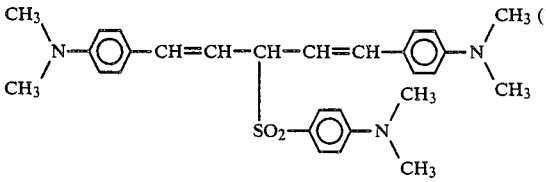

(10)

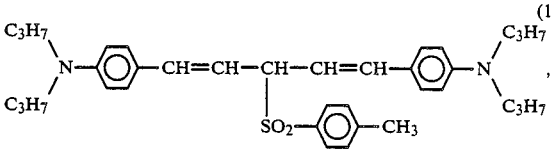

(11)

and

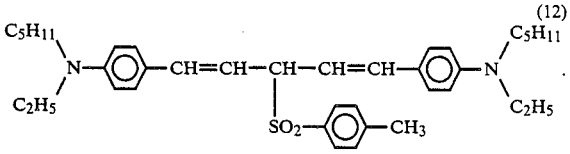

(12)

3. The thermosensitive recording material as claimed in claim 1, wherein said color developer is selected from the group consisting of:

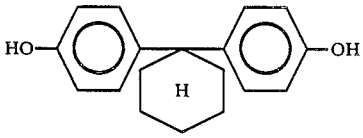

(1)

-continued

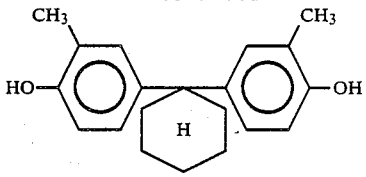

(2)

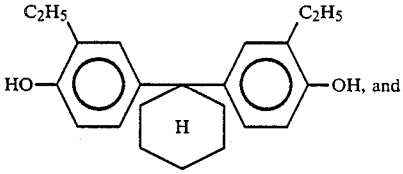

(3)

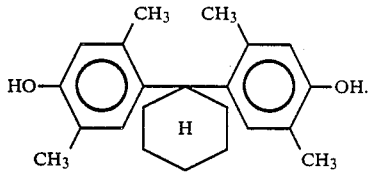

(4)

4. The theromosensitive recording material as claimed in claim 1, wherein said thermosensitive coloring layer further comprises a second leuco dye capable of absorbing light in the visible region.

5. The thermosensitive recording material as claimed in claim 4, wherein said second leuco dye is selected from the compounds having general formula (III),

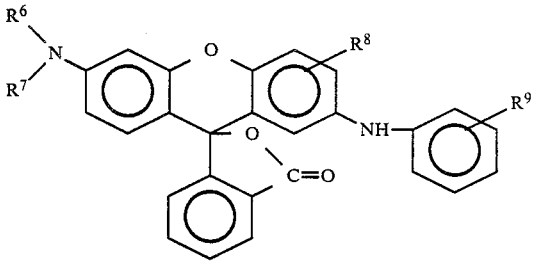

(III)

wherein $R^6$ and $R^7$ each represent a saturated or unsaturated hydrocarbon group having 1 to 10 carbon atoms, which may be in a cyclic or non-cyclic form and may include an ether bond therein, $R^8$ represents a hydrocarbon group having 1 to 2 carbon atoms, or halogen, and $R^9$ represents hydrogen, halogen, or a hydrocarbon group having 1 to 6 carbon atoms.

6. In a thermosensitive recording material comprising a support material and a thermosensitive coloring layer formed on said support material, said thermosensitive coloring layer comprising a colorless or light-colored leuco dye component and a color developer capable of inducing color formation in said leuco dye upon application of heat thereto, the improvement wherein said lueco dye component comprises (i) a compound having general formula (I),

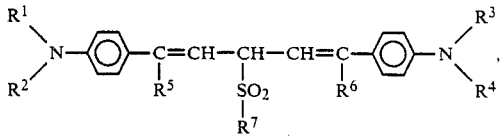

(I)

wherein $R^1$, $R^2$, $R^3$ and $R^4$ each represent hydrogen or an alkyl group having a substituent, $R^5$ and $R^6$ each represent hydrogen or a phenyl group which may have a substituent, and $R^7$ represents an alkyl group which may have a substituent or a phenyl group which may have a substituent, and (ii) 3-(N-methyl-N-cyclohexylamino-6-methyl-7-anilinofluroan, and said color developer is a compound having general formula (II),

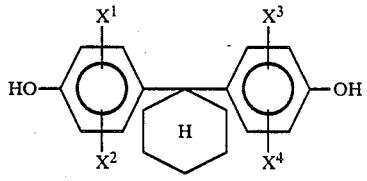

(II)

wherein $X^1$, $X^2$, $X^3$ and $X^4$ each represent hydrogen or an alkyl group having 1 to 4 carbon atoms.

* * * * *

UNITED STATES PATENT AND TRADEMARK OFFICE

CERTIFICATE OF CORRECTION

PATENT NO. : 4,857,502

DATED : August 15, 1989

INVENTOR(S) : Takashi Ueda, et al

It is certified that error appears in the above-identified patent and that said Letters Patent is hereby corrected as shown below:

On the title page:

The city of residence is incorrect "Numaza" should be:

--Numazu--

Signed and Sealed this

Seventeenth Day of July, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,857,502

DATED : August 15, 1989

INVENTOR(S) : Ueda et al.

It is certified that error appears in the above-identified patent and that said Letters Patent is hereby corrected as shown below:

Column 1, line 16, change "thermo-sensitive" to --thermosensitive--

Column 15, line 50, change "PSC Value(%)" to --PCS Value(%)--

Column 16, line 27, change "[Liquid C-31]" to --[Liquid C-3]--

Column 17, line 27, change "material No. was prepared." to --material No. 3-1 was prepared.--

Column 21, line 11, change "3-(N-methyl-N-cyclohexylamino-6-methyl" to --3-(N-methyl-N-cyclohexyl)amino-6-methyl--

Signed and Sealed this

Nineteenth Day of March, 1991

*Attest:*

HARRY F. MANBECK, JR.

*Attesting Officer*

*Commissioner of Patents and Trademarks*